United States Patent [19]

Sukava et al.

[11] Patent Number: 4,779,579

[45] Date of Patent: Oct. 25, 1988

[54] ROTARY ENGINE

[76] Inventors: Sulo Sukava, General Delivery, Dryden, Ontario, Canada, P8N 2Y6; Larry Sukava, 3194 Saltario Crescent, Regina, Saskatchewan, Canada, S4V 1C9

[21] Appl. No.: 79,655

[22] Filed: Jul. 29, 1987

[51] Int. Cl.[4] ..... F02B 57/06

[52] U.S. Cl. ..... 123/43 A; 123/565

[58] Field of Search ..... 123/43 A, 43 AA, 58 B, 123/58 BA, 65 BA, 565

[56] References Cited

U.S. PATENT DOCUMENTS

| | | | |
|---|---|---|---|
| 980,491 | 1/1911 | Coleman | 123/43 A |
| 1,275,494 | 8/1918 | Storle | 123/43 A |
| 1,345,808 | 7/1920 | Reynolds | 123/43 A |
| 2,456,164 | 12/1948 | Youhouse | 123/43 A X |
| 2,776,649 | 1/1957 | Fenske | 123/43 A X |
| 3,695,237 | 10/1972 | Londo | 123/43 A |
| 3,970,055 | 7/1976 | Long | 123/43 A |

FOREIGN PATENT DOCUMENTS

| | | | |
|---|---|---|---|
| 113711 | 3/1918 | United Kingdom | 123/43 AA |

*Primary Examiner*—Michael Koczo

*Attorney, Agent, or Firm*—Ciotti & Murashige, Irell & Manella

[57] ABSTRACT

A bank of piston and cylinder assemblies is formed in a cylinder block and is mounted for rotation within bearings. The piston rods are operatively connected to the pistons and bearing supports on an angled plate journalled for rotation at one end of the block and shafts extend axially from the block and the plate and are connected together by a universal joint for rotation as a unit. A centrally located fuel/air chamber is formed axially through the block and fuel/air compression and vaporizing fans rotate with the chamber as the block rotates and feeds fuel/air mixtures through inlet ports to the cylinders successively as the pistons uncover the inlet ports. An exhaust ring surrounds the block and is adjustable radially and exhaust ports from the cylinders coincide with an exhaust outlet in the ring also successively. The engine operates on the two stroke principle, each cylinder firing every 360° of rotation but splash lubrication is provided thus eliminating fuel/oil mixture.

20 Claims, 6 Drawing Sheets

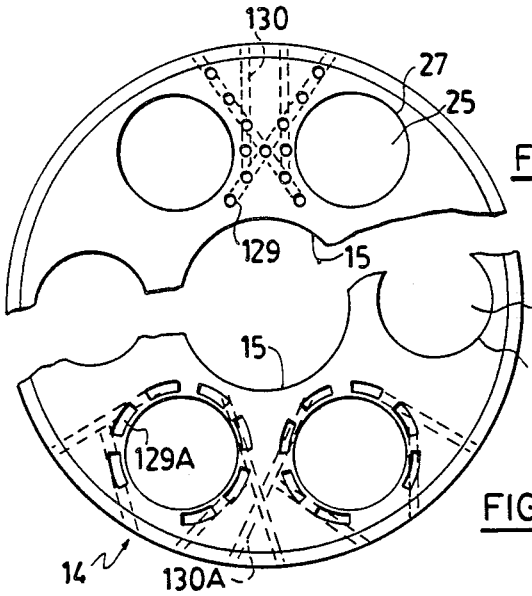
FIG.13
FIG.14
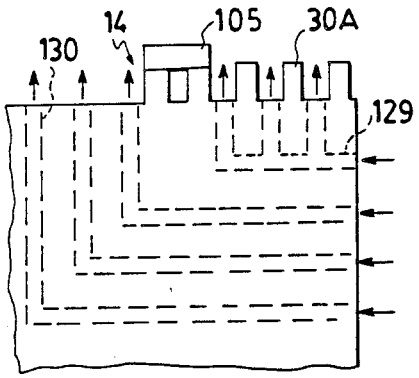
FIG.13A
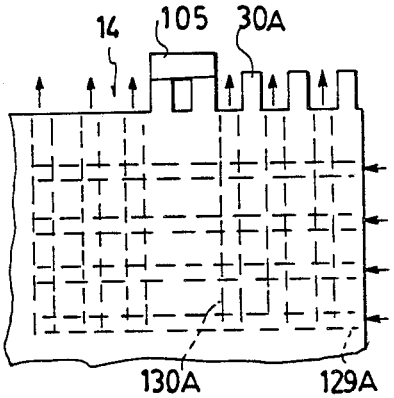
FIG.14A

ROTARY ENGINE

BACKGROUND OF THE INVENTION

This invention relates to new and useful improvements in rotary engines, particularly rotary engines in which the cylinder block and piston assembly rotates as a unit and is connected by a constant velocity universal joint or the like, to an angled plate from which the input is taken.

The basic concept of a rotating cylinder block and angled plate is known and is exemplified in U.S. Pat. No. 980,491 (C.J. Coleman) issued Jan. 11th, 1911.

This shows a four-stroke type engine secured to a rotating shaft and mounted in a base. with the shaft being connected at one end by means of a universal joint, to an angled plate member supported in bearings and with the power takeoff situated at the other end of the shaft. Intake and exhaust functions are controlled by means of poppet type valves located in the cylinder head.

U.S. Pat. No. 1,345,808 (G. A. Reynolds) issued July 6th, 1920, shows a somewhat similar arrangement operating on a four-stroke principle and with rocker arm actuated valves being situated in the cylinder head and including a drive shaft which extends through the axis of the engine.

U.S. Pat. No. 1,275,494 (O. O. Storle) issued Aug. 18th, 1918, shows a structure similar to 1,345,808 with rocker arm actuated valves and linkage connections between the axial shaft and the angled plate.

U.S. Pat. No. 3,695,237 (Londo) issued Oct. 3rd, 1972, discloses a similar type engine only actuating on a pure two-stroke principle with transfer ports incorporated therein and an axial shaft extending through the engine block.

U.S. Pat. No. 3,970,055 (Long) issued July 20th, 1976, discloses an external combustion engine with a piston driven unit utilizing uniflow principles with transfer ports upon each side of the pistons for transferring the exhaust from one side to the other thereby extracting additional energy from each has charge through a second expansion before finally exhausting the gas.

However, the present design overcomes disadvantages inherent with the prior art structures by reducing the moving parts to the minimum, eliminating rocker arms, poppet type valves and other linkages, and by providing an axially located intake and compression chamber in the cylinder block which incorporates a compression fan and a heating and atomizing fan rotating with the block to assist in the proper preparation of the fuel/oil mixture prior to injecting same into the cylinders surrounding the intake and compression chamber.

Furthermore, the present device incorporates a lubrication system which eliminates the necessity of mixing oil and fuel together as is usual with two-stroke type engines and also eliminates the use of transfer ports between the crank case and the compression chambers of the cylinders.

Some of the prior art patents mentioned above require slideable seals, gears, springs and an odd number of cylinders in order to operate and four-cycle designs require oil pumps for lubrication.

In accordance with the invention, there is provided a rotary engine operating on the two-stroke principle comprising in combination a cylinder block including a hollow hub at one end thereof, bearing means for supporting said hub for rotation together with said cylinder block, an axially located intake compression chamber formed through said block and a plurality of cylinder bores also formed through said block in radially equidistant location around said intake compression chamber, a cylinder head detachably secured to one end of each of said cylinder bores, an angle plate, means journalling said angle plate for rotation, the longitudinal axis of said cylinder block and the longitudinal axis of said angle plate lying at an obtuse angle with one another, means operatively connecting said block with said angle plate along the axis thereof whereby they rotate together, a piston reciprocal in each cylinder bore, a connecting rod operatively connected to and extending from each of said pistons, means equidistantly spaced around the axis of said angle plate for operative connection of the other ends of each of said connecting rods, fuel/air inlet means adjacent one end of said intake compression chamber, the other end of said intake compression chamber being closed, a fuel/air vapourizing and mixing fan secured to and rotating with said upper end of said intake compression chamber, a fuel/air compression fan mounted adjacent the other end of said intake compression chamber, spaced from said vapourizing and mixing fan, a fuel/air intake port extending from said intake compression chamber between said fans, to each of said cylinders, a stationary exhaust ring surrounding said cylinder block in sealing relationship therewith and having an exhaust outlet formed therethrough, an exhaust port extending from each cylinder and registering successively with said exhaust outlet as each cylinder rotates thereby, carburetor means operatively connected through said hub to said intake compression chamber and ignition means operatively connected to each of said cylinder heads.

A further advantage of the invention is that it operates on a fuel induction concept With the fuel mixture being maintained under positive pressure during operation which assists in the complete charging of the cylinders on the intake stroke.

A further object of the invention is to provide control and adjustment of the timing of the exhaust opening sequence which together with electronic ignition timing control, permits accurate adjustment of the operation of the engine.

Another advantage of the present invention is to provide a novel piston design particularly suited for the lubrication thereof in a two-stroke cycle operation and which furthermore permits ready access to the balljoint connection between the connecting rods and the pistons.

A still further advantage of the invention is to provide a device of the character herewithin described which is basically simple in construction and which incorporates the minimum of moving parts thus reducing considerably the number of parts which may wear and which also permits adequate cooling and lubrication during operation.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

FIG. 13 is a partial plan view of the cylinder block showing one method of eliminating hot areas thereof.

FIG. 13A is a schematic view of the operation of the system of FIG. 13.

FIG. 14 is a partial plan view of the cylinder block showing an alternative method of eliminating hot areas thereof.

FIG. 14A is a schematic view of the operation of the system of FIG. 14.

In the drawings like characters of reference indicate corresponding parts in the different figures.

DETAILED DESCRIPTION

Figure 1:
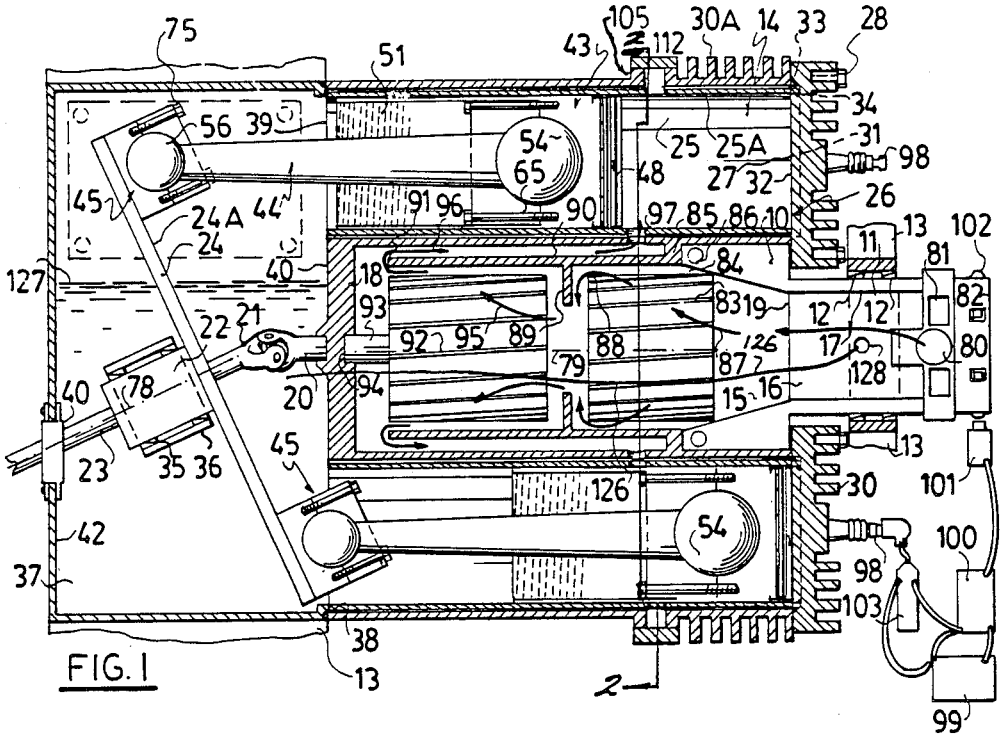
FIG. 1 is a transverse partial sectional view of the engine.
Figure 2:
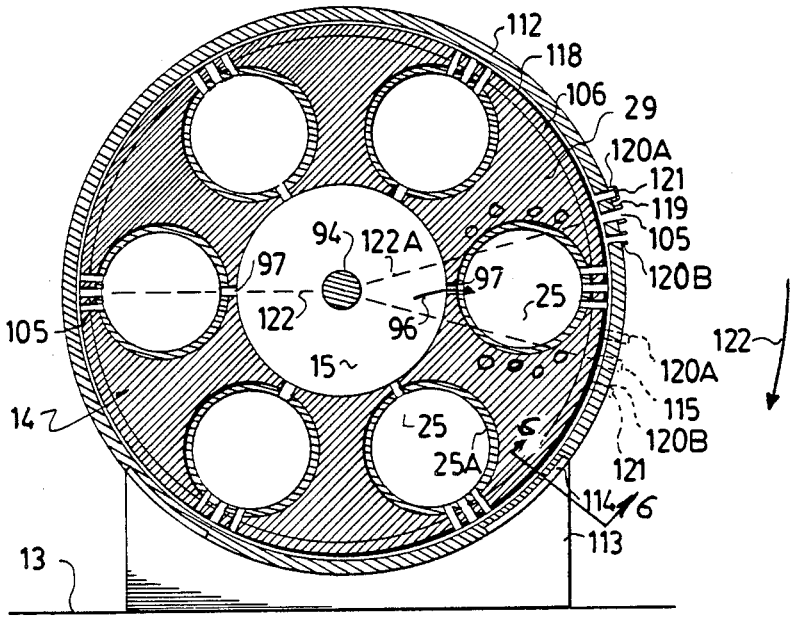
FIG. 2 is a partial cross-section along the line 2—2 of FIG. 1.
Figure 3:
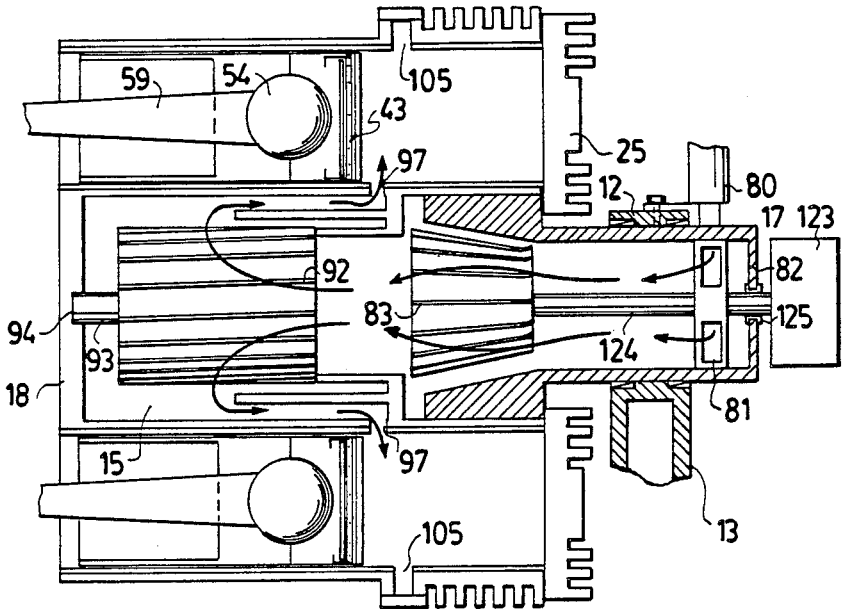
FIG. 3 is a fragmentary sectional view of the intake end of the engine showing an alternative embodiment.

Proceeding therefore to describe the invention in detail, reference should first be made to FIGS. 1 and 2 in which reference character 10 illustrates a cylindrical hub preferably formed from steel and having a hollow stub shaft 11 extending upon one side thereof being journalled for rotation within a heavy duty bearing assembly collectively designated 12 which in turn is mounted upon supporting structure illustrated schematically by reference character 13.

A cylindrical cylinder block collectively designated 14 is preferably formed from aluminium and is mounted to the hub 10 and is in axial relationship with the shaft 11.

This cyliner block includes a relatively large diameter central bore 15 which operatively connects with a fuel-/air tube 16 formed axially through the hub and connecting with the bore 17 of the tubular shaft 11.

The other end of this axial bore 15 is closed as indicated by reference character 18 thus defining an axially located intake compression chamber between the closed end 18 and the hub inner surface 19 as will hereinafter be described.

A stub shaft 20 extends axially from the other side of the closed end 18 of the cylinder block and connects to a constant velocity universal joint assembly illustrated schematically by reference character 21 which is also mounted upon a hub 22 of an output shaft 23, the hub being axially located upon an angle plate 24 which is substantially circular in configuration.

A plurality of cylinder bores 25 are formed through the cylinder block 14 radially and equidistantly spaced from the longitudinal axis of the cylinder block and these bores extend clear through the block and it is desirable that the number of pores be an even number rather than an odd number as is required in some of the prior art patents hereinabove described such as U.S. Pat. Nos. 980,491 and 1,345,808 both of which require such an odd number in order to operate. It is preferable to have said bores both large in diameter and long. However any practical number could be fitted in order to vary total engine cylinder displacement and power output, as desired.

Each bore is provided with a steel cylinder liner 25A in a conventional manner, said liner being easily replaced when necessary.

Each cylinder bore also includes a cylinder head collectively designated 26 detachably secured upon one end 27 of each bore by means of bolts 28 engaging with the end wall 29 of the block and in this connection, the bolts are preferably staggered as shown in phantom in FIG. 2 to ensure the correct rotational location of each cylinder head in order to align cooling fins 30 so that balance is maintained when the cylinder block is rotating.

It is also preferable that a recess 31 be formed in each cylinder head which engages over the protruding end portion 32 of the liner 25A and seats against a copper-asbestos gasket 33 surrounding the liner where it protrudes from the surface of the cylinder block. The upper end 32 of the liner may be externally chamfered as at 34 to facilitate the engagement of the heads 26 with the extending portion of the liners 25A.

The aforementioned hub 22 extending from the circular angle plate 24 is supported within bearing assemblies 35 which in turn are supported by a mounting base 36 secured to supporting base 13. These components, stub shaft 20, universal joint 21, plate 24 and hub 22 and the like, are contained within a stationery housing 37 which acts as an oil sump with a two-section oil seal 38 (see FIG. 12) being situated annularly between the end 39 of the housing and the base 40 of the cylinder block and output shaft 23 extends through the housing, through an oil seal 41 in the end wall 42 of the housing.

Figure 12:
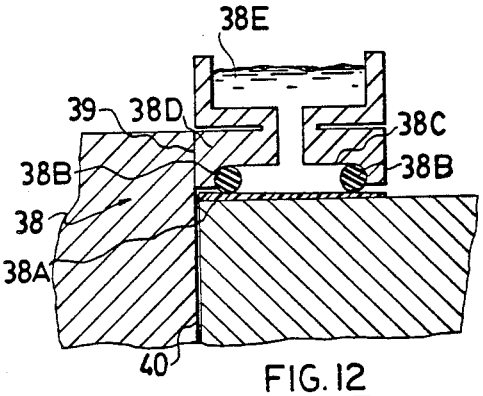
FIG. 12 is a fragmentary cross-sectional view of the junction between the oil housing and the block and illustrates the two-part seal therebetween.

FIG. 12 shows details of the two-section oil seal 38 in which the outer surface of the end 40 of the block is slightly tapered as indicated at 38A for ease and accuracy in assembly. The two-section seal comprises a pair of spaced and parallel O-rings 38B situated within a recess 38C formed in the annular flange 38D extending from the end 39 of the oil housing. A high temperature grease gravity feed reservoir 38E is operatively connected to this recess 38C and a grease such as LUBRE-PLATE (Trade Mark) acts as a good lubricant and oil seal because it does not readily mix with oil.

A piston collectively designated 43 is provided for each cylinder bore 25 and is reciprocal therein. Each cylinder is connected, by means of a connecting rod collectively designated 44, to a bearing assembly collectively designated 45 situated adjacent the periphery of the angle plate 24 and upon the inner face 24A thereof. Each connecting rod 44 is also connected internally to the corresponding piston assembly 43.

Reference to FIGS. 8–11 show details of the piston assemblies and the connection thereof of the connecting rod.

Figure 10:
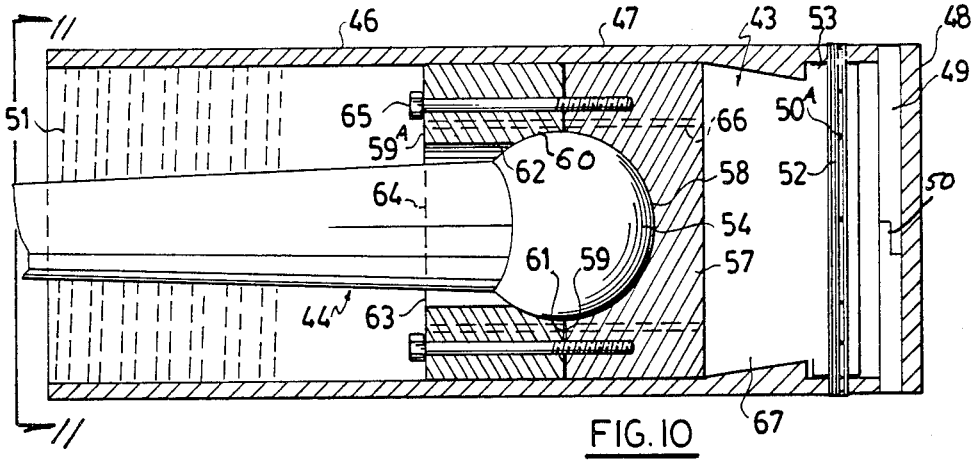
FIG. 10 is an enlarged longitudinal view partially sectioned, of one of the pistons and showing the connection of the connecting rod thereto.
Figure 8:
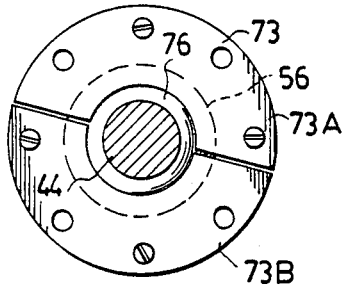
FIG. 8 is a view substantially along the line 8—8 of FIG. 9.
Figure 11:
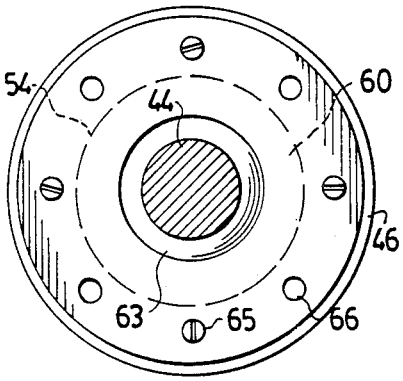
FIG. 11 is a view along the line 11—11 of FIG. 10.
Figure 9:
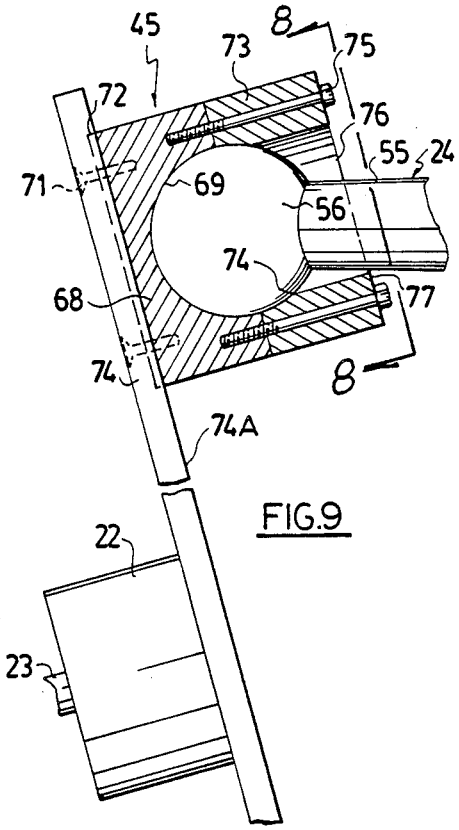
FIG. 9 is an enlarged partially cross-sectional view of the connection of the connecting rod to the ring plate.

Reference to FIG. 10 will show that each piston is relatively long and includes a piston skirt 46, a main body portion 47 and a piston head 48.

At least one compression ring 49 is provided in a corresponding groove adjacent the head 48 and is stepped as at 50 to allow for expansion yet still maintain a compressive seal between the piston and the cylinder liner 25A.

The outside surface of the skirt 46 is provided with a spiral groove 51 which carries oil from the sump 37 and lubricates the portion of the cylinder liner in which the piston reciprocates.

An oil control ring 52 is provided spaced downwardly from the compression ring 49 and apertures 50*a* extend through the base of the groove to the interior of the piston and in particular to an annular recess 53 formed around the inside of the piston head 48 so that oil from the sump in the form of mist or splash feed may pass into the interior of the piston, outwardly through the drillings 50 and lubricate the portion of the cylinders that the upper ends or head portions of the pistons reciprocate.

The connecting rod 44 is circular in cross section and is formed with a ball 54 on one end thereof with the diameter of the interconnecting rod gradually decreasing from this ball 54 towards the other end 55 which is also provided with a ball 56, it being understood that the entire connecting rod 44 is preferably machined from one piece. It is important to note that the diameter of ball 54 is considerably greater than the diameter of ball 56 in order to supply a greater bearing and lubricating surface for supporting the piston 43 than is required for the connection with the angle plate 24 which is continuously running in oil.

A block 57 is secured within the piston and is provided with a hemispherical recess 58 on one side 59 thereof.

A further block 59*a* is also provided with a hemispherical recess 60 corresponding to recess 58 and upon one side 61 thereof. A cylindrical bore 62 extends from the other side 63 of block 59*a*, to the centre of the recess on a side 61, said bore having a diameter larger than the diameter 64 of the piston rod where it passes through the bore (see FIG. 10). This allows for pivotal movement of the piston rod and ball 54 relative to the piston 43 when same is reciprocating within the cylinder liners 25.

Bolts 65 extend through the block 59*a* and screwthreadably engage within block 57 to clamp the two blocks around the ball 54 thus providing a ball joint and lubrication is from the underside of the piston and through the bore 62, to the balljoint thus providing a relatively large film of oil for lubrication and support purposes.

Drillings or bores 66 extend through blocks 57 and 59*a* and convey oil from the underside of the pistons through the drillings 66 to the area 67 above or to the piston head side of block 57 from where it may pass through drillings 50 and out through the slotted control ring 52 to the cylinder wall.

The lower end or small end 56 of the connecting rod 24 is mounted to the plate 24 in a somewhat similar manner, it being understood however that block 59*a* may be engaged over the ball 56 and moved upwardly along the rod 44 to its position on the underside of ball 54.

However, in the cas of the ball 56, a base block 68 having a hemispherical recess 69 formed on one face 70 thereof is secured to the surface 24A of plate 24 by means of bolts 71 extending through the plate and engaging the block which is recessed within a cylindrical recess 72 on the face 24A for location purposes. The outer block 73 is formed in two halves 73A and 73B shown in FIG. 8 with each half having a part of a hemispherical recess 74 iormed thereon so that when they are engaged around the ball 56 and bolted to block 68 by means of bolts 75, they complete the hemispherical recess and provide bearing support for the ball 56 in conjunction with recess 69 in block 68. Once again, a cylindrical bore 76 is formed through block 73 from the face 77 thereof to provide room for the connecting rod 24 to oscillate as the pistons reciprocate and also to supply oil from the sump in which they operate, to the bearing ball joint formed by ball 56 and the hemispherical recesses 69 and 74.

It will be seen therefore that as the cylinder block rotates, together with the angle plates 24, the pistons will reciprocate within their relevant cylinders an amount depending upon the angular relationship of the longitudinal axis 78 of the plate assembly and the longitudinal axis 79 of the cylinder block. The angle between these axes being an obtuse angle. It will also be appreciated that this angle also controls the stroke of the pistons within the cylinders.

A conventional carburetor 80 shown schematically in FIG. 1 is operatively connected to the interior of the shaft 11 by means of ports 81 extending through the wall thereof outboard of the bearings 12, it being understood that the end 82 of the shaft is closed.

The fuel/air mixture is drawn into the intake and compression chamber 15 by means of a squirrel-cage fan assembly 83 supported upon the wall of the cylinder block defining this chamber. In this connection a plurality of lugs 84 extend from the periphery of the fan unit and are bolted against an annular shoulder 85 extending inwardly from the wall of the chamber, screwbolts 86 forming the attaching means, and this blower fan is preferably formed from steel and is of a centrifugal type which is conventional. It draws the fuel/air into the centre thereof and expels it circumferentially as indicated by arrows 87 and 88. It then meets an inwardly extending radial wall 89 which is secured to an annular shell 90 extending from shoulder 85, towards the closed end 18 of the chamber, terminating at a point indicated by reference character 91.

Situated in the portion of the chamber between the annular plate 89 and the end 18, is an aluminium mixing and atomizing fan assembly collectively designated 92. This is mounted upon a stub shaft 93 secured within a recess 94 formed axially in the end wall 18 of the chamber 15 so that this fan also rotates with the cylinder block as does fan 83.

Being formed from aluminium, fan 92, which is also of a squirrel-cage configuration, picks up heat from the operation of the engine and vaporizes as well as atomizes the fuel droplets and mixes them thoroughly with the air which has also entered via carburetor 80 with the travel of this fuel/air mixture following arrows 95 and 96, arrows 96 indicating that the fuel/air mixture is travelling in a reverse direction in the annular chamber formed by shell 90 and the wall of the chamber 15.

Intake ports 97 extend through the wall of the chamber 15 into each of the cylinders and cylinder liners 25 and 25A clearly shown in FIG. 2 so that when a piston is at the equivalent of bottom dead centre, as shown by the uppermost piston in FIG. 1, the fuel/air mixture which is under positive pressure within chamber I5, is injected into the cylinder above the piston head 48.

This occurs as successive pistons reach the bottom dead centre position during 360° rotation of the assembly, it being appreciated that the inlet ports 97 are situated through the cylinder walls just above the position of the piston head 48 when the pistons are at bottom dead centre positions.

Each cylinder head 26 is provided with a spark plug 98 which is operatively connected to a source of ignition shown schematically in FIG. 1. It consists of a conventional storage battery 99 connected to an ignition control module 100 which is conventional operatively connected to an h.e.i. coil pickup 101 controlled by a reluctor assembly 102 secured to and surrounding the end of shaft 17 adjacent the closed end 82 thereof. The module in turn is connected to a coil 103 which provides a spark to the cylinder which is in the firing position by means of air gap contact 104. The reluctor pads 105 control the ignition module which in turn controls the coil and provides the spark at the desired instant that it is required when the piston is at the equivalent of top dead centre as indicated by the bottom piston in FIG. 1.

Figure 5:
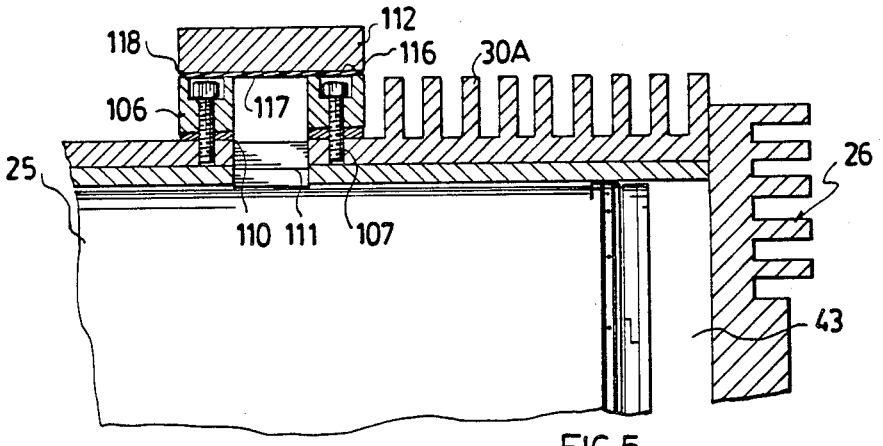
FIG. 5 is an enlarged fragmentary cross-sectional view of the exhaust ring assembly.
Figure 6:
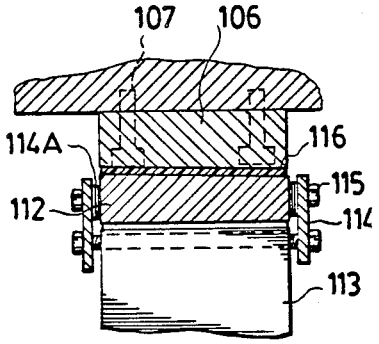
FIG. 6 is an enlarged fragmentary cross-sectional view along the lines 6—6 of FIG. 2.
Figure 7:
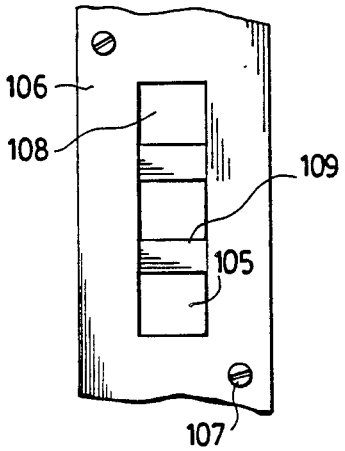
FIG. 7 is an enlarged fragmentary view of the fixed exhaust ring showing the ports therethrough.

Exhaust ports 105 are provided through each cylinder wall to the exterior of the cylinder block and through a fixed exhaust ring 106 surrounding the block and being secured thereto by recessed bolts 107 (see FIGS. 5, 6 and 7). In order to provide sufficient cross sectional area for efficient exhaust, it is preferable that three such ports be provided for each cylinder formed by the rectangular aperture 108 formed in ring 106 and bridged by spacers or strips 109.

Reference to FIG. 5 will show that the undersurface 110 of the ring 106 is tapered and engages a taper 111 formed on the outer side of the cylinder wall or block thus providing for accurate assembly over the cylinder assembly and also providing an adequate seal between the ring 106 as clearly shown. It should be understood that there is an exhaust port through ring 106 for each cylinder as shown in FIG. 2.

An exhaust ring 112 surrounds ring 106 and is supported within a stationary outer ring mounting base 113 shown in FIG. 2. This includes clamp plates 114 holding the ring in position relative to the cylinder block so that the exhaust ring 112 may be adjusted circumferentially within limits for timing purposes, clamp bolts 115 maintaining the ring in the desired annular relationship with the cylinder block. Once again, a taper mount 116 is provided between the inner surface of the exhaust ring 112 and the outer surface 117 of the rotating ring 106 and a Teflon seal illustrated by reference character 118 is provided between the stationary ring Il2 and the rotating ring 106 for sealing purposes. (See FIG. 5.) A plurality of shims 114A are provided between each of the clamp plates 114 and the exhaust ring 112 for lateral adjustment in order to take up wear between the exhaust ring 112 relative to the taper mount 116.

A main exhaust port 119 is provided through the fixed ring 112 at a location where it is desired to exhaust each cylinder as it passes port 119 and the aforementioned adjustment of the stationary ring 112 assists in this positioning.

A pair of exhaust gas recirculating ports 120A and 120B are provided through the fixed ring 112, one upon each side of the main exhaust port 119. One of these exhaust gas recirculating ports is capped as at 121 with the other being connected by means of flexible tubing (not illustrated) to the intake of the carburetor for recirulation of part of the exhaust gases. This permits the engine to rotate in either direction when operating depending upon circumstances. In FIG. 2, the engine is shown rotating in a clockwise direction indicated by reference character 122 so that the last portion of the exhaust gases are recirculated.

If, however, the engine rotates in the opposite direction, then port 120B would be capped and port 120A would be connected to the carburetor and the ring would be rotated so that the ports are in the position shown in phantom in FIG. 2.

The choice of rotating the engine in either direction is useful, particularly when the engine is used under circumstances such as operating an oil well or drilling rig which conventionally uses two separate engines to accomplish the reverse rotation whereas use of the present engine would of course provide considerable cost savings.

In operation, the assembly is rotated by a conventional electric starter so that the fans 83 and 92 draw in fuel/air mixture from the carburetor and feeds same successively through the ports 97 of the cylinders as the relevant piston reaches bottom dead centre.

Further rotation of this particular piston will compress the fuel/air mixture until it reaches top dead centre shown by the lower piston in FIG. 1 whereupon the spark plug fires causing the expansion and power stroke to occur which assists in moving the piston downwardly and continuing the rotation of the engine. As the piston uncovers the exhaust ports 105, the residual pressure within the cylinder exhausts the gases with the exhaust port opening prior to the uncovering of the intake port. It will be noticed that the exhaust port opens prior to the piston reaching the inlet port so that a slight negative pressure is developed in the cylinder which assists in the charging of the cylinder through the inlet port 97 once it has been uncovered by the piston at bottom dead centre as shown in the upper half of FIG. 1.

As soon as the piston commences movement towards top dead centre, the inlet port is covered and of course the exhaust port remains closed during the compression and firing stroke so that a two-stroke action is obtained without the necessity of compressing the fuel/air mixture below the piston in the crankcase as is conventional. This eliminates transfer ports and valves and also permits conventional lubrication to be used rather than mixing the oil with the fuel which restricts the fuel to gasoline apart from causing pollution.

Figure 4:
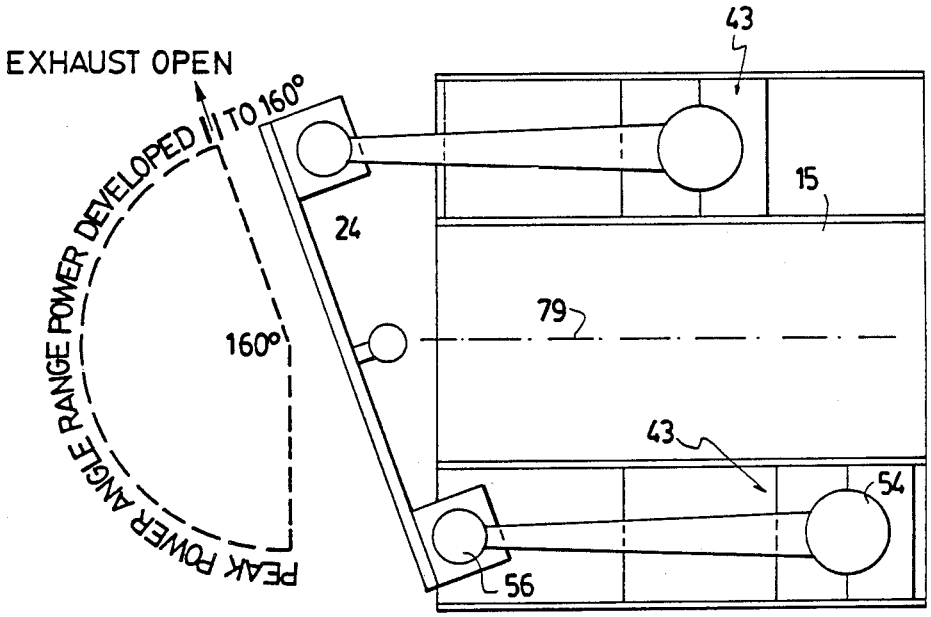
FIG. 4 is a schematic view of the angle plate portion of the engine showing power development characteristics.

Reference to FIGS. 2 and 4 will show the power development of this particular engine and dealing with first with FIG. 2, the six cylinders 25 illustrated have been indicated by function at one particular point of rotation. It will be noted that one of the cylinders is indicated as having the intake port "open" and the next three cylinders all are indicated as being under compression with the cylinder diametrically opposite to the one with the intake port open, being at top dead centre and ready to fire.

The firing stroke occurs at this point indicated by the dotted line 122 in FIG. 2 and extends through approximately 160° of rotation to the dotted line 122A at which point the exhaust port opens and closes prior to the intake port opening with the operative exhaust gas recirculating port being situated between the main exhaust port 105 and the intake port 97.

This means that the peak power angle range extends through approximately 90° but continues to be developed until the exhaust port opens at approximately 160° as shown schematically in FIG. 4 so that the operation provides maximum torque at the centre of the plate 24.

As rotative power is developed by lever action torque, the several advantages of the present engine over conventional design are clearly shown in the following.

In the present engine, complete combustion occurs over approximately the first inch of piston travel, producing instant maximum torque over approximately 90° of rotation with long lever advantage. By contrast, in conventional design, while combustion occurs, peak torque is not developed until the second inch of piston travel over about 45° of rotation with only short lever advantage and about a one-third drop from initial working or power pressure.

Depending upon the fuel being used, the engine may be started as hereinbefore described. However, with some fuels, the fan unit 83 may not be rotating fast enough to introduce the fuel/air mixture to the chamber 15.

Under these circumstances, a high-speed, 12-volt motor 123 may be powered by the storage battery 99 when starting, said motor driving a shaft 124 through a sealed bearing 125 in closed end plate 82, with the fan 83 being secured to the inner end of the shaft. This will provide sufficient initial airflow to provide the fuel/air mixture to the chamber 15, it being understood that as soon as sufficient speed of rotation is developed by the engine, this motor 123 may be disconnected and the fan unit 83 is then rotated by the engine itself.

Figure 15:
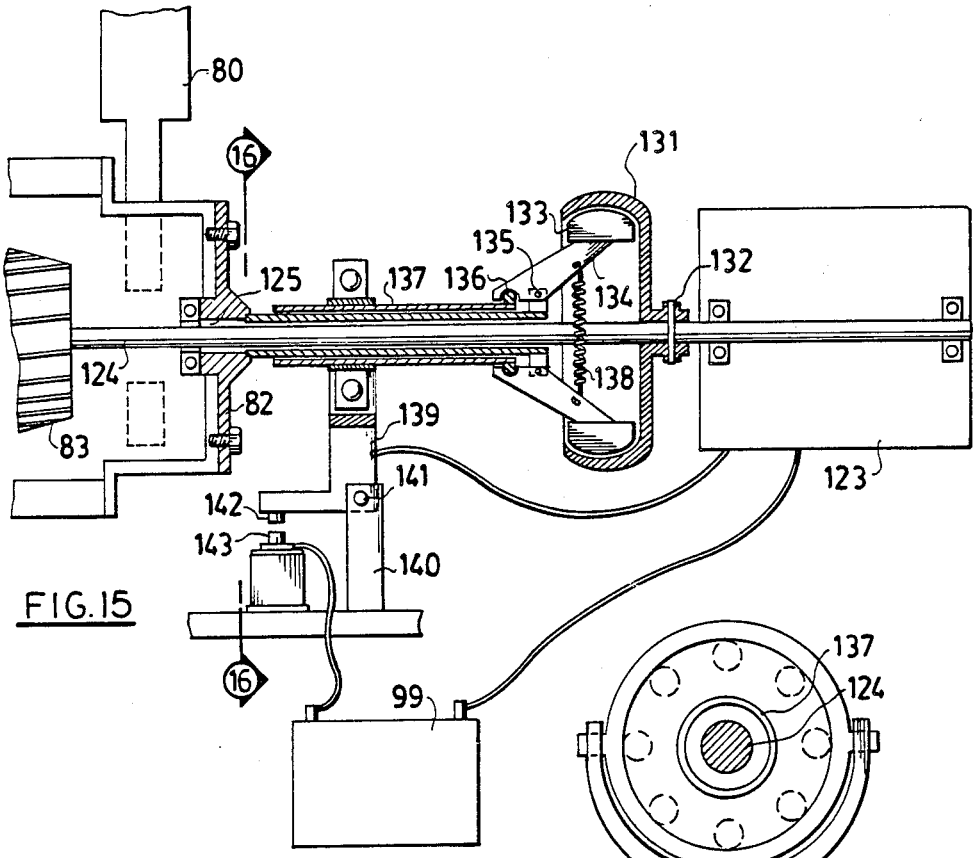
FIG. 15 shows a partially schematic elevation of the squirrel cage fan assembly and pre-start motor.
Figure 16:
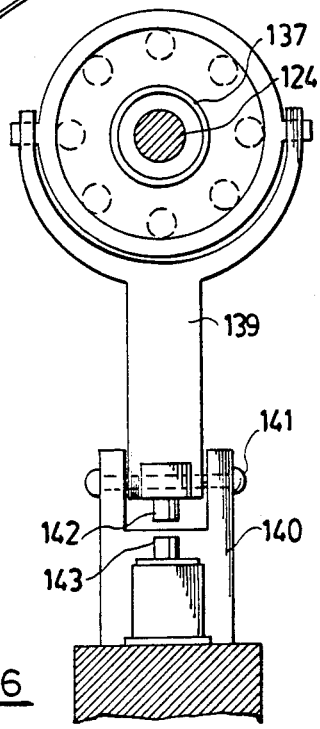
FIG. 16 is a section along the line 16—16 of FIG. 15.

In this connection, reference should be made to FIGS. 15 and 16 which shows a hub 131 fixed to shaft 124 by means of pin 132.

Friction units 133 are situated on pivoted arms 134 mounted upon pivot 135 and slideably engaging over the flange 136 of a bearing sleeve 137 and with a spring 138 normally retracting the friction units. The sleeve bearing 137 includes crank arm 139 pivoted on support 140 by pivot pin 141. When the spring 138 retracts the friction units, the contact 142 on the end of the crank arm 139 is contacting the other contact 143 thus completing the circuit to the 12-volt motor 123, when the ignition is switched on.

This high-speed motor rotates the fan 83 and when the desired engine r.p.m. is reached, the friction unit contact the hub 131 while actuating the bearing yoke assembly and rotating the crank arm slightly around pivot 141 thus separating points 142 and 143 which cuts off the current to the motor so that the assembly runs as a unit with the armature on shaft 124 rotating with the assembly but not drawing any current.

Reference should be made to FIG. 1 which shows a conduit 126 extending from the oil 127 within the sump 37, to a wick type feed 128 to the wall of the shaft 11 to provide lubrication to the bearing surface 12, it being understood that the oil level is always maintained within the sump, above the wick level so that oil is always present at the wick, by gravity.

It will also be appreciated that the compression may be varied by varying the angle of the angle plate 24. This may be occasioned by swivelling the mounting base 36 upon the support 13 to increase or decrease the obtuse angle between the longitudinal axis of the angle plate assembly and the main cylinder block assembly.

Finally, reference should be made to FIGS. 13, 13A, 14 and 14A which shows two methods of eliminating hot spots or areas between cylinder bores.

The first method shown in FIG. 13 comprises a plurality of drilled apertures 129 formed downwardly from the upper end of the cylinder block and situated between adjacent cylinder bores. Each of these apertures is connected to a cross bore or drilling 130 extending from the bases of several of the drillings 129, to the side or parametrical wall of the cylinder block. These vertical drillings are formed between the cylinder heads and cylinder bores so that, because the cylinder block is facing forwardly, air is drawn in from the front of the block downwardly through the bores 129 and then radially outwardly to the periphery of the cylinder block via the cross bores 130.

FIGS. 14 and 14A show a slightly different configuration in which substantially rectangular air spaces 129A are formed around each cylinder bore and connected by cross bores or drillings 130A, to the periphery of the block. These act in a manner similar to the system illustrated and described in FIGS. 13 and 13A.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What is claimed:

1. A rotary engine operating on the two stroke principle comprising in combination a cylinder block including a hollow hub at one end thereof, bearing means for supporting said hub for rotation together with said cylinder block, an axially located intake compression chamber formed through said block and a plurality of cylinder bores also formed through said block in radially equidistant location around said intake compression chamber, a cylinder head detachably secured to one end of each of said cylinder bores, an angle plate, means journalling said angle plate for rotation, the longitudinal axis of said cylinder block and the longitudinal axis of said angle plate lying at an obtuse angle with one another, means operatively connecting said block with said angle plate along the axis thereof whereby they rotate together, a piston reciprocal in each cylinder bore, a connecting rod operatively connected to and extending from each of said pistons, means equidistantly spaced around the axis of said angle plate for operative connection of the other ends of each of said connecting rods, fuel/air inlet means adjacent one end of said intake compression chamber being closed, a fuel/air vapourizing and mixing fan secured to and rotating with said one end of said intake compression chamber, a fuel/air compression fan mounted adjacent the other end of said intake compression chamber, spaced from said vapourizing and mixing fan, a fuel/air intake port extending from said intake compression chamber at an axial location which is between said fans, to each of said cylinders, a stationary exhaust ring surrounding said cylinder block in sealing relationship therewith and having an exhaust outlet formed therethrough, an exhaust port extending from each cylinder and registering successively with said exhaust outlet as each cylinder rotates thereby, carburetor means operatively connected through said hub to said intake compression chamber and ignition means operatively connected to each of said cylinder heads.

2. The engine according to claim 1 in which said connecting rods each include means operatively connecting same by one end thereof to a respective piston, said means including a ball formed on said one end of said connecting rod, and means in said respective piston for bearingly engaging said ball, said means operatively connecting said other end of said connecting rod to said plate including a ball formed on the other end of said connecting rod and means on said plate for bearingly engaging said ball on the other end of said connecting rod, the diameter of said ball on said one end of said connecting rod being greater than the diameter of said ball on said other end of said connecting rod.

3. The engine according to claim 2 which includes means in said piston for detachably securing said ball on said one end of said connecting rod in pivotal relationship to said piston, said last mentioned means including a block formed in said piston adjacent the head thereof, a semi-spherical recess in said block, and a cap block detachably secured to said block, said cap block having a semi-spherical recess formed on one side thereof matching said recess in said block, a central aperture through said cap block extending from the other side thereof to said recess therein, said recesses bearingly receiving said ball on said one end of said connecting rod with said connecting rod freely extending through said central aperture in said cap block, when assembled.

4. The engine according to claim 2 in which said means on said angle plate for operative connection of said ball on said other end of said con rod includes an angle plate block secured to one side of said plate for each of said connecting rods, a semi-spherical recess formed in said plate, a two-part split block, each part having a matching semi-cylindrical bore for free engagement around said connecting rod and having a semi-spherical recess formed on one face thereof when assembled, and matching said recess in said plate block, said recesses bearingly receiving said ball on said other end of said connecting rod.

5. The engine according to claim 3 in which said means on said angle plate for operative connection of said ball on said other end of said connecting rod includes an angle plate block secured to one side of said plate for each of said connecting rods, a semi-spherical recess formed in said plate, a two-part split block, each part having a matching semi-cylindrical bore for free engagement around said connecting rod and having a semi-spherical recess formed on one face thereof when assembled, and matching said recess in said plate block, said recesses bearingly receiving said ball on said other end of said connecting rod.

6. The engine according to claim 1 in which each of said pistons includes a skirt and a spiral lubricating groove formed around the outer surface of said skirt and extending from adjacent the lower end thereof to part way along the length of said skirt.

7. The engine according to claim 1 in which each of said cylinder heads includes cooling fins thereon and includes means to ensure correct circumferential positioning of said head relative to said cylinder bore to maintain mass balance of said engine when assembled.

8. The engine according to claim 1 in which each of said pistons includes at least one oil scraper ring, a groove around the outer surface of said piston head for receiving said ring, and a cooling recess formed internally of said head adjacent said oil scraper ring groove, and apertures extending through the base of said groove to said recess.

9. The engine according to claim 1 which includes means adjacent the inner end of said hub to support said compression fan, said last mentioned means including a plurality of lugs extending inwardly of said hub and corresponding lugs extending from the pheriphery of said fan for detachable securement to said lugs extending from said hub.

10. The engine according to claim 1 in which said exhaust ring is adjustable circumferentially within limits to control the relationship of intake and exhaust actions of each of said piston and cylinders.

11. The engine to claim 10 which includes a stationary base for supporting said exhaust ring, clamp means on said base, lugs extending from said exhaust ring and engaging with said clamps, said lugs and hence said ring being adjustably secured to said clamps and an exhaust gas recirculating port extending through said ring, radially spaced from said exhaust outlet.

12. The engine according to claim 11 which includes an exhaust gas recirculating port on each side of said exhaust outlet, one of said exhaust gas recirculating ports being operatively connected to said carburetor means and one being detachably capped, depending upon the direction of rotation of said engine.

13. The engine according to claim 1 which includes an annular barrier plate extending from the wall of said intake and compression chamber at an axial location between said fans, said intake port being situated between said barrier and said vapourizing and mixing fan, said barrier routing said air/fuel mixture through said compression fan to the circumference thereof, inwardly and through said carrier plate into said vapourizing and mixing fan, outwardly through the circumference thereof and back to said barrier and through said inlet port.

14. In a rotary engine operating on the two stroke principle which includes a cylinder block including a hollow hub at one end thereof, bearing means for supporting said hub for rotation together with said cylinder block, an axially located intake compression chamber formed through said block and a plurality of cylinder bores also formed through said block in radially equidistant location around said intake compression chamber, a cylinder head detachably secured to one end of each of said cylinder bores, an angle plate, means journalling said angle plate for rotation, the longitudinal axis of said cylinder block and the longitudinal axis of said angle plate lying at an obtuse angle with one another, means operatively connecting said block with said angle plate along the axis thereof whereby they rotate together; the improvement which includes a piston reciprocal in each cylinder bore, a connecting rod operatively connected to and extending from each of said pistons, means equidistantly spaced around the axis of said angle plate for operative connection of the other ends of each of said connecting rods, fuel/air inlet means adjacent one end of said intake compression chamber, the other end of said intake compression chamber being closed, a fuel/air vapourizing and mixing fan secured to and rotating with said one end of said intake compression chamber, a fuel/air compression fan mounted adjacent the other end of said intake compression chamber, spaced from said vapourizing and mixing fan, a fuel/air intake port extending from said intake compression chamber at an axial location between said fans, to each of said cylinders, a stationary exhaust ring surrounding said cylinder block in sealing relationship therewith and having an exhaust outlet formed therethrough, an exhaust port extending from each cylinder and registering successively with said exhaust outlet as each cylinder rotates thereby, carburetor means operatively connected through said hub to said intake compression chamber and ignition means operatively connected to each of said cylinder heads.

15. The improvement according to claim 14 in which said connecting rods each include means operatively connecting same by one end thereof to a respective piston, said means including a ball formed on said one end of said connecting rod, and means in said respective piston for bearingly engaging said ball, said means operatively connecting said other end of said connecting rod to said plate including a ball formed on the other end of said connecting rod and means on said plate for bearingly engaging said ball on the other end of said connecting rod, the diameter of said ball on said one end of said connecting rod being greater than the diameter of said ball on said other end of said connecting rod.

16. The improvement according to claim 15 which includes means in said piston for detachably securing said ball on said one end of said connecting rod in pivotal relationship to said piston, said last mentioned means including a block formed in said piston adjacent the head thereof, a semi-spherical recess in said block, and a cap block detachably secured to said block, said cap block having a semi-spherical recess formed on one side thereof matching said recess in said block, a central aperture through said cap block extending from the other side thereof to said recess therein, said recesses bearingly receiving said ball on said one end of said connecting rod with said connecting rod freely extending through said central aperture in said cap block, when assembled.

17. The engine according to claim 15 in which said means on said angle plate for operative connection of said ball on said other end of said connecting rod includes an angle plate block secured to one side of said plate for each of said connecting rods, a semi-spherical recess formed in said plate, a two-part split block, each part having a matching semi-cylindrical bore for free engagement around said connecting rod and having a semi-spherical spherical recess formed on one face thereof when assembled, and matching said recess in said plate block, said recesses bearingly receiving said ball on said other end of said connecting rod.

18. The improvement according to claim 14 in which each of said pistons includes a skirt and a spiral lubricating groove formed around the outer surface of said skirt and extending from adjacent the lower end thereof to part way along the length of said skirt.

19. The improvement according to claim 14 in which said exhaust ring is adjustable circumferentially within limits to control the relationship of intake and exhaust actions of each of said piston and cylinders.

20. The engine to claim 19 which includes a stationary base for supporting said exhaust ring, clamp means on said base, lugs extending from said exhaust ring and engaging with said clamps, said lugs and hence said ring being adjustably secured to said clamps and an exhaust gas recirculating port extending through said ring, radially spaced from said exhaust outlet.

* * * * *